US006763647B2

(12) United States Patent
Yeany

(10) Patent No.: US 6,763,647 B2
(45) Date of Patent: Jul. 20, 2004

(54) WINDOW FRAMING SYSTEM

(75) Inventor: Scott Allen Yeany, Bogart, GA (US)

(73) Assignee: Formtech Enterprises, Inc., Stow, OH (US)

( * ) Notice: Subject to any disclaimer, the term of this patent is extended or adjusted under 35 U.S.C. 154(b) by 0 days.

(21) Appl. No.: 10/065,478

(22) Filed: Oct. 22, 2002

(65) Prior Publication Data

US 2003/0024182 A1 Feb. 6, 2003

(51) Int. Cl.[7] ..... E04C 2/54
(52) U.S. Cl. ..... 52/786.1; 52/204.55; 52/204.597
(58) Field of Search ..... 52/204.67, 204.68, 52/204.55, 204.597, 204.72, 455, 204.7, 204.62; 49/380

(56) References Cited

U.S. PATENT DOCUMENTS

| | | | | | |
|---|---|---|---|---|---|
| 3,750,358 | A | * | 8/1973 | Lewkowitz | 52/204.597 |
| 4,750,310 | A | * | 6/1988 | Holcombe | 52/731.3 |
| 4,947,597 | A | * | 8/1990 | Simpson | 52/208 |
| 5,018,330 | A | * | 5/1991 | Lewkowitz | 52/455 |
| 5,106,225 | A | * | 4/1992 | Andre et al. | 403/408.1 |
| 5,123,211 | A | | 6/1992 | Schlicht et al. | |
| 5,189,862 | A | | 3/1993 | Lafleur | |
| 5,369,923 | A | * | 12/1994 | Schilt | 52/208 |
| 5,577,355 | A | * | 11/1996 | Leonelli | 52/204.62 |
| 5,636,484 | A | * | 6/1997 | DeBlock | 52/204.5 |
| 5,749,184 | A | * | 5/1998 | McKann | 52/204.1 |
| 5,758,458 | A | | 6/1998 | Ridge | |
| 5,797,229 | A | * | 8/1998 | Alvarez et al. | 52/204.62 |
| 5,852,910 | A | * | 12/1998 | Zebedee | 52/784.1 |
| 6,141,922 | A | | 11/2000 | Carlisle et al. | |
| 6,151,849 | A | * | 11/2000 | Twigg et al. | 52/208 |
| 6,318,037 | B1 | * | 11/2001 | Hansen | 52/208 |
| 6,351,915 | B1 | * | 3/2002 | Puckett | 52/167.1 |
| 6,546,682 | B1 | * | 4/2003 | DeBlock et al. | 52/204.72 |
| 2001/0035268 | A1 | | 11/2001 | Desrochers | |
| 2002/0059758 | A1 | | 5/2002 | Dodson et al. | |

FOREIGN PATENT DOCUMENTS

| | | |
|---|---|---|
| EP | 1067268 | 10/2001 |
| GB | 2353316 | 2/2001 |
| HU | 218249 | 12/1992 |

* cited by examiner

*Primary Examiner*—Carl D. Friedman
*Assistant Examiner*—Christy Green
(74) *Attorney, Agent, or Firm*—Buckingham, Doolittle & Burroughs, LLP; Louis F. Wagner

(57) ABSTRACT

The invention relates to window framing systems which seal against exterior surfaces, particularly embossed surfaces. The system is held together with a plurality of screws. The inner component of the frame contains at least one hollow void having a V-shaped strut which provides additional structural support to the inner component and minimizes any dimpling or screw breakthrough due to the use of automatic screwdrivers having a torque which is in excess of the mechanical strength of the inner frame member.

38 Claims, 2 Drawing Sheets

WINDOW FRAMING SYSTEM

BACKGROUND OF INVENTION

The invention relates to window framing systems which seal against exterior door surfaces, and particularly garage door surfaces, including embossed surfaces. The extruded fame is held together with a plurality of screws in which the extruded hollow frame into which the screw is inserted contains a hollow void having a V-shaped strut contained therein which provides additional structural support to the hollow member and minimizes any dimpling or screw breakthrough due to the use of automatic screwdrivers having a torque which is in excess of the mechanical strength of the extruded hollow frame member.

Consumers often request the inclusion of a series of decorative windows in garage doors and exterior door surfaces in general. When used in a garage, these windows are usually incorporated into the upper section of the garage door. The windows are formed in individual panels of the upper section and provide daylight illumination of the closed garage. A window opening is generally cut or preformed in each panel into which a window is to be inserted.

Insertion of windows into the window openings typically involves fastening two hollow extruded frames together within the garage door. In order to maximize the speed with which this operation could be performed, installers typically use automatic screwdrivers or screwdriver bits inserted into drills. These tools, are designed for high speed screwing operations and generally possess a sufficient degree of power to screw right through the extruded hollow frame if the operator is either working too fast or carelessly.

The Prior Art solutions fail to effectively provide a window framework system which permits high speed installation without the attendant problems of improper installation or aesthetically-imperfect installation.

SUMMARY OF INVENTION

In accordance with the present invention, there is provided a hollow extruded window frame with improved structural integrity which permits the quick installation of window frames minimizing the possibility of dimpling or screw breakthrough.

It is an object of this invention to effect screwing engagement of a front and a rear window frame system wherein the rear window frame contains additional structural support.

It is another object of this invention to improve the aesthetics of the installed window frame thereby reducing consumer rejection of various installations.

These and other objects of this invention will be evident when viewed in light of the drawings, detailed description and the pending claims.

BRIEF DESCRIPTION OF DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION

Figure 1:
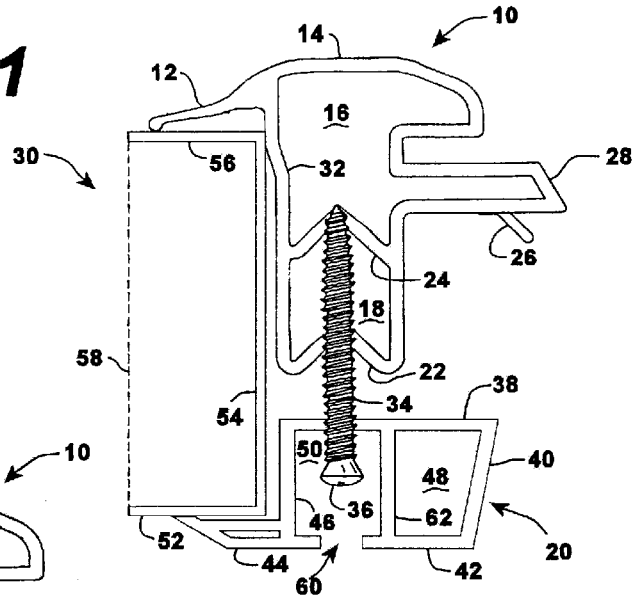
FIG. 1 is a cross-sectional view of a front and a rear window frame having hollow portions disposed, said hollow portions support by essentially vertical structural support and illustrating a screw which has been improperly installed due to overtightening resulting in the head of the screw breaking through the surface of the frame.

Referring now to the drawings wherein the showing is for the purpose of illustrating the preferred embodiment of the invention only and not for purposes of limiting the same, the figures show how the improved internal structural design of the window frame can eliminate or at least minimize the plastic deformations or breakthrough which may occur when using automatic screwing devices.

As illustrated in FIG. 1, the window framing system is shown having an exterior extruded window frame 10, and interior extruded window frame 20 and a portion of a garage door 30. Exterior window frame 10 is an extruded piece having two hollow voids 16, 18, said voids separated by an inwardly-facing (or inverted) V-shaped internal support 24. The exterior frame has a peripherally extending foot 12 for contacting engagement with an exterior wall 56 of a garage door, a exterior surface 14, two side surfaces 28, 32 and a bottom surface 22, said bottom surface often characterized as an inwardly-facing V-shape. Interior side surface 28 often has a plurality of indentations as well as a flexible sealing strip 26 for contact with a pane of glass (not shown) while opposing exterior side surface 32 is often in contact with at least a portion of an interior side 54 of garage door 30. Interior frame 20 is also an extruded piece having two hollow voids 48, 50, said voids separated by a perpendicular inner wall 62. The interior frame has a peripherally extending foot 44 for contacting engagement with an interior wall 52 of the garage door, an interior surface 38, two side surfaces 40, 46 and an exterior wall 42, at least a portion of side surface 46 often being in physical contact with at least a portion of interior side 54 of garage door 30.

During installation of the window framing system, the outer frame 10 and inner frame 20 are secured in fastening engagement by a plurality of screws having threads 34 and heads 36. When using high speed and high torque screwdrivers and drills having screwdriver bits positioned thereinto, the probability exists that through rapid rotational movement of the screw into the exterior wall 42 of inner frame 20, with subsequent penetration through interior wall 38 of said frame, followed by fastening engagement with inverted V-shaped bottom surface 22 of exterior frame 10, and often corresponding inverted V-shaped middle wall 24 of the frame, screw head 36 often penetrates through exterior wall 42 thereby creating an unsightly aperture 60 where none is intended. This also creates a loose fitting arrangement between the inner and outer frames, causing customer rejection of that installation.

Figure 2:
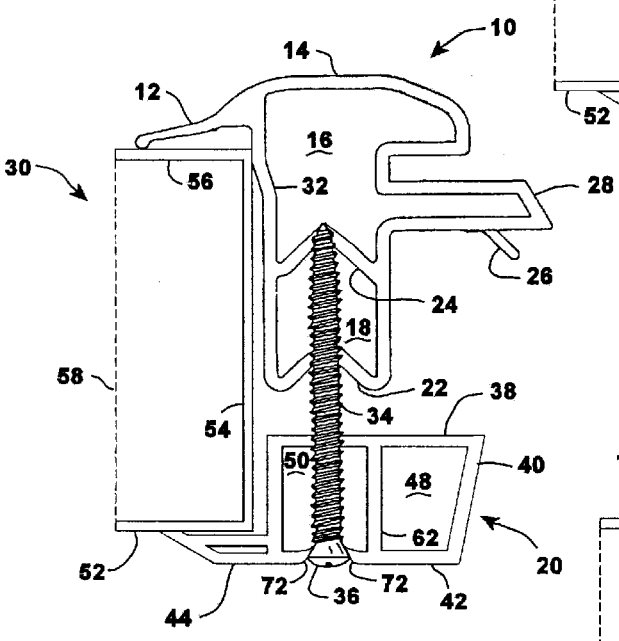
FIG 2 is a cross-sectional view of a window frame of FIG. 1 showing a second improper installation due to overtightening of the screw resulting in a dimpling of the surface of the inner window frame.

As illustrated in FIG. 2, not only is screw penetration an issue, but so is exterior wall 42 deformation caused by screw head 36 being overtightened, but not to the point of causing penetration therethrough as illustrated in FIG. 1. The dimpling 72 is still unacceptable to the consumer and often causes customer rejection of that installation.

Figure 3:
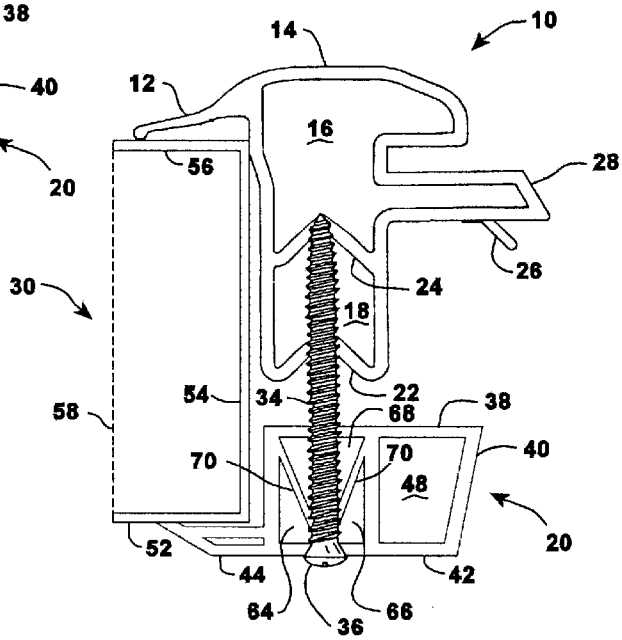
FIG. 3 is a cross-sectional view of a window frame of FIG. 1 showing the improved internal design of the hollow frame member which minimizes the problems identified in FIGS. 1–2.
Figure 4:
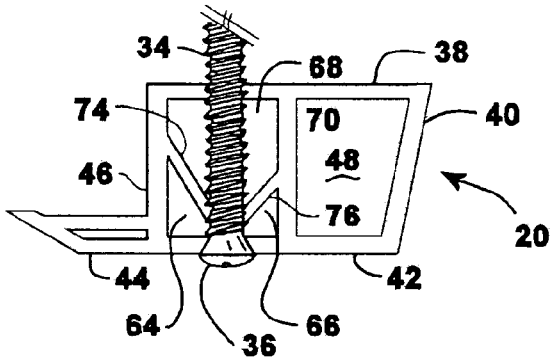
FIG. 4 is a cross-sectional view of an interior extruded frame showing non-mirror image structural supports.

FIG. 3 innovatively solves the problems illustrated in FIGS. 1 and 2 by placing additional structural support at precisely the location needed. By the incorporation of additional angled struts 70, shown V-shaped in this embodiment, creates three voids 64, 66, 68 wherein only one void 50 existed previously. The internal bracing provides compressive longitudinal resistance to increased penetrational longitudinal movement of the screw and screw head thereby minimizing if not eliminating the dimpling 72 evidenced in FIG. 2 and apertured breakthrough 60 evidenced in FIG. 1. While the additional structural support 70 is shown as V-shaped, it is important that this feature will be achieved by any non-perpendicular support which forms a plurality of triangular cavities 64, 66, 68, although it is recognized that the shape of the structural support and resulting cavity defined therein can be other than triangular, one of the important facets being angularity of a support 74, 76 illustrated in FIG. 4, at the location of screw penetration, such support laterally migrating toward interior surface 38 although not necessarily touching this surface in that the terminus of supports 70 could be either interior wall 62 or side wall 46 or combinations thereof. It is important that the structural support be positioned at an acute angle as defined by the structural support and exterior wall 42 of inner frame 20.

Figure 5:
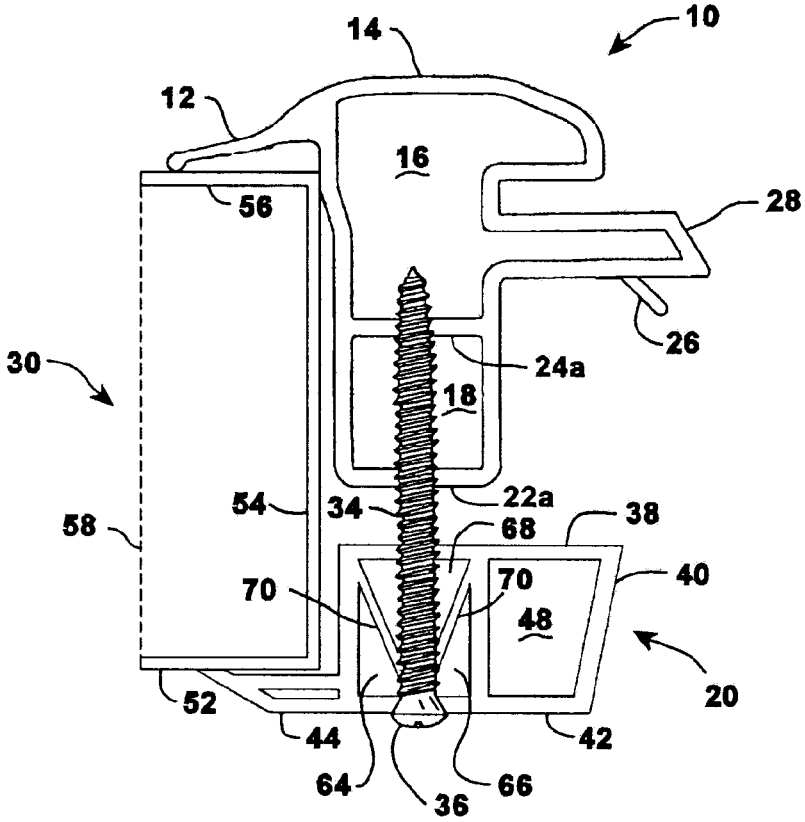
FIG. 5 is a cross-sectional view of an alternative embodiment of the invention illustrated in FIG. 3 showing the improved internal design of the hollow frame member in conjunction with a non-"V" shaped external frame member.

FIG. 5 illustrates an alternative embodiment of the invention wherein fastening engagement is with horizontal bottom surface 22*a* rather than inverted V-shaped bottom surface 22 of exterior frame 10 shown in FIG. 3 as well as horizontal middle wall 24*a* rather than corresponding inverted V-shaped middle wall 24 of exterior frame 10 shown in FIG. 3. It is additionally recognized that while exterior frame 10 is shown as an extruded shape, there is no need to limit the invention to such, and this frame component may be solid plastic, wood, metal, e.g., both hollow and non-hollow aluminum, etc.

This invention has been described in detail with reference to specific embodiments thereof, including the respective best modes for carrying out each embodiment. It shall be understood that these illustrations are by way of example and not by way of limitation.

What is claimed is:

1. A window frame which comprises:

(a) an outer extruded frame having at least one internal void disposed therein; and (b) an inner extruded frame having an interior-facing side, an exterior-facing side and two opposed sides, said inner frame having at least one enclosed internal void disposed therein between said sides, (i) said at least one inner internal void having at least two non-perpendicular supports disposed within said sides, said supports in contact with said interior-facing side from within said enclosed void; and (c) a connecting means to secure said inner and outer frame in connected relationship to each other, said connecting means penetrating through said interior-facing and exterior-facing sides into said outer extruded frame.

2. The frame of claim 1 wherein (a) said at least two non-perpendicular supports are "V-shaped."

3. The frame of claim 1 wherein (a) said at least two non-perpendicular supports are a mirror image of each other.

4. The frame of claim 1 wherein (a) said at least two non-perpendicular supports are not a mirror image of each other.

5. The frame of claim 1 wherein (a) said outer extruded frame has at least one member which is inverted "V-shaped."

6. The frame of claim 5 wherein (a) said at least one inverted "V-shaped" member is a bottom interior-facing member.

7. The frame of claim 6 wherein (a) said at least one inverted "V-shaped" member is at least two "V-shaped" members in longitudinal spaced apart relationship.

8. The frame of claim 6 wherein (a) said connecting means to secure said inner and outer frames in connected relationship is a threaded fastener.

9. A window frame which comprises:

(a) an outer extruded frame having at least one internal void disposed therein; and (b) an inner extruded frame having an interior-facing side, an exterior-facing side and two opposed sides said inner frame having at least one enclosed internal void disposed between said sides, (i) said at least one internal void in said inner frame having at least two non-perpendicular supports disposed therein, said supports positioned closer to each other and contacting said interior-facing side where a fastening means will penetrate therein from within said enclosed void, said supports and said interior-facing side each forming an acute angle therebetween; and (c) said inner and outer frame in connected relationship to each other by said fastening means.

10. The frame of claim 9 wherein (a) said at least two non-perpendicular supports are "V-shaped."

11. The frame of claim 9 wherein (a) said at least two non-perpendicular supports are a mirror image of each other.

12. The frame of claim 9 wherein (a) said at least two non-perpendicular supports are not a mirror image of each other.

13. The frame of claim 9 wherein (a) said outer extruded frame has at least one member which is inverted "V-shaped."

14. The frame of claim 13 wherein (a) said at least one inverted "V-shaped" member is a bottom interior-facing member.

15. The frame of claim 14 wherein (a) said at least one inverted "V-shaped" member is at least two "V-shaped" members in longitudinal spaced apart relationship.

16. The frame of claim 14 wherein (a) said fastening means is a threaded fastener.

17. The frame of claim 16 wherein (a) said threaded fastener is a screw.

18. A member which comprises:

(a) an extruded frame having an interior-facing side, an exterior-facing side and two opposed sides, said frame having at least one enclosed internal void disposed between said sides; and (b) said at least one inner internal void having at least two non-perpendicular supports disposed therein, said supports positioned closer to each other and contacting said interior-facing side where a fastening means will penetrate therein from within said enclosed void, said supports and said interior-facing side each forming an acute angle therebetween.

19. The frame of claim 18 wherein (a) said at least two non-perpendicular supports are "V-shaped."

20. The frame of claim 18 wherein (a) said at least two non-perpendicular supports are a mirror image of each other.

21. The frame of claim 18 wherein (a) said at least two non-perpendicular supports are not a mirror image of each other.

22. A member which comprises:

(a) an extruded frame having an interior-facing side, an exterior-facing side and two opposed sides, said frame having at least one enclosed internal void disposed within said sides, (b) said at least one inner internal void having at least two non-perpendicular supports disposed therein, said supports in contact with an inside of said interior-facing side.

23. The frame of claim 22 wherein (a) said at least two non-perpendicular supports are "V-shaped."

24. The frame of claim 22 wherein (a) said at least two non-perpendicular supports are a mirror image of each other.

25. The frame of claim 22 wherein (a) said at least two non-perpendicular supports are not a mirror image of each other.

26. A window frame which comprises:

(a) an outer frame having at least one surface capable of penetration by a fastening means therein;

(b) an inner extruded frame having an interior-facing side, an exterior-facing side and two opposed sides said inner frame having at least one enclosed internal void disposed between said sides, (i) said at least one internal void in said inner frame having at least two non-perpendicular supports disposed within said sides, said supports contacting an inside of said interior-facing side; and (c) said inner and outer frame in connected relationship to each other by said fastening means.

27. The frame of claim 26 wherein (a) said at least two non-perpendicular supports are "V-shaped."

28. The frame of claim 26 wherein (a) said at least two non-perpendicular supports are a mirror image of each other.

29. The frame of claim 26 wherein (a) said at least two non-perpendicular supports are not a mirror image of each other.

30. The frame of claim 26 wherein (a) said fastening means is a threaded fastener.

31. The frame of claim 30 wherein (a) said threaded fastener is a screw.

32. The frame of claim 26 wherein (a) said outer frame is selected from the group consisting of wood, foam and metal.

33. A window frame which comprises:

(a) an outer frame having at least one surface capable of penetration by a fastening means therein; and (b) an inner extruded frame having an interior-facing side, an exterior-facing side and two opposed sides, said inner frame having at least one enclosed internal void disposed between said sides, (i) said at least one internal void in said inner frame having at least two non-perpendicular supports disposed therein, said supports positioned closer to each other at and contacting said interior-facing side where a fastening means will penetrate therein from within said enclosed void, said supports and said exterior side each forming an acute angle; and (c) said inner and outer frame in connected relationship to each other by said fastening means.

34. The frame of claim 32 wherein (a) said at least two non-perpendicular supports are "V-shaped."

35. The frame of claim 32 wherein (a) said at least two non-perpendicular supports are a mirror image of each other.

36. The frame of claim 32 wherein (a) said at least two non-perpendicular supports are not a mirror image of each other.

37. The frame of claim 32 wherein (a) said threaded fastener is a screw.

38. The frame of claim 32 wherein (a) said outer frame is selected from the group consisting of wood, foam and metal.

* * * * *